United States Patent [19]

McIlvin

[11] Patent Number: 4,642,829

[45] Date of Patent: Feb. 17, 1987

[54] SHOE UPPER LINER EXTENDER MECHANISM

[75] Inventor: Donald B. McIlvin, Danvers, Mass.

[73] Assignee: USM Corporation, Farmington, Conn.

[21] Appl. No.: 656,136

[22] Filed: Sep. 28, 1984

[51] Int. Cl.[4] ..... A43D 11/00; B05B 7/06

[52] U.S. Cl. ..... 12/54.3; 118/411

[58] Field of Search ..... 12/52.5, 54.3, 54.6, 12/61 R, 61 B, 64, 146 D; 118/411; 219/215

[56] References Cited

U.S. PATENT DOCUMENTS

| | | | |
|---|---|---|---|
| 3,316,573 | 5/1967 | Chaplick et al. | 36/68 |
| 4,127,910 | 12/1978 | Hollick | 12/146 D |
| 4,344,199 | 8/1982 | Bouzianis et al. | 12/54.3 |
| 4,521,176 | 6/1985 | Bouzianis et al. | 12/54.3 |

FOREIGN PATENT DOCUMENTS

| | | | |
|---|---|---|---|
| 2024602 | 1/1980 | United Kingdom | 118/411 |

*Primary Examiner*—Henry S. Jaudon
*Assistant Examiner*—Steven N. Meyers
*Attorney, Agent, or Firm*—Spencer T. Smith

[57] ABSTRACT

A machine for applying resinous stiffening material to the heel pocket portion of a shoe upper, and for holding a liner portion thereattached, away from the upper heel and sides by a liner extender as the resinous material is being applied, and then wiping the liner against the resinous upper while liner extender is being withdrawn from between the layers of material.

The liner extender is comprised of a loop member articulately upwardly and outwardly from a nozzle as it advances to the heel pocket articulately downwardly and backwardly toward the nozzle during completion of the application of resinous material between the flexible layers of the shoe upper.

3 Claims, 3 Drawing Figures

SHOE UPPER LINER EXTENDER MECHANISM

BACKGROUND OF THE INVENTION (1) Field of the Invention

This invention relates to shoe machines and more particularly to machines for stiffening portions of a shoe upper.

(2) Prior Art

Stiffening of portions of shoe uppers by coating the portion to be stiffened with a layer of molten resin and solidifying the resin was disclosed in U.S. Pat. No. 3,316,573 to Chaplick et al. In that patent, molten thermoplastic polymeric material was spread as a layer on a shoe upper at a temperature at which the thermoplastic material has a viscosity low enough to wet and adhere to the surface of the article to be stiffened, but sufficiently high so that it will not substantially penetrate the shoe component. The layer of material so formed was cooled and shaped to form a stiff resilient layer holding the article in the desired configuration.

U.S. Pat. No. 4,127,910 to Hollick discloses the stiffening of a selected area of sheet material such as a shoe upper through the use of a procedure of forming a layer of resin from a hot molten source which is particularly adapted for use in stiffening of heel end portions of the shoe upper. According to that patent, a molten resin is spread over an area of flexible sheet material to be stiffened. After the resin had been applied, a reciprocable spreader lays the lining of the shoe upper upon the molten resin, by withdrawal thereof, backwardly. The problem with this apparatus is that the machine operator cannot see the machine operation.

The heel portion of the shoe upper is directed downwardly and the extruder and spreader block the view of the operator.

U.S. Pat. No. 4,344,199 to Bouzianis et al shows an advance over the aforementioned '910 patent, disclosing a further machine for stiffening portions of flexible material whereby a reciprocable and rotatable nozzle on an extruder deposits molten resin onto the inner side of a shoe upper in the heel upright orientation. A flexible rubber finger and a roller extender are shown pivotally arranged in front of the nozzle for holding the lining away from the outer layer of the upper while the nozzle is depositing the resin and the finger wipes the liner inwardly as the nozzle and extruder are withdrawn. The rubber finger would deteriorate quickly from the heat of the liner, and the roller tended to hold the lining away in a pint, which was insufficiently wide enough for most applications, and the roller itself would get gummed-up with resin, not facilitating a quality application of the resin on the shoe upper.

It is an object of the present invention to overcome the disadvantages of the prior art.

It is a further object of the present invention to provide wiping means which will not deteriorate under heat and will be easily cleanable in service.

It is a further object of the present invention to provide a liner extender which will provide ample room within the counter pocket for the nozzle to operate, which extender will provide resiliency thereto and facilitate cleaning under service.

BRIEF SUMMARY OF THE INVENTION

The present invention involves a liner extender arrangement for use with a machine for stiffening sheet material, particularly shoe uppers. The machine includes means for softening a resin into a flowable state for application of that resin to the shoe upper. The machine also includes a spreader nozzle having a plurality of orificii disposed thereon, the nozzle being rotatably supported on an extruder. The interior of the extruder is in fluid flow communication with the interior of the spreader nozzle and the extruder is in fluid flow communication with the softening means. A liner extender is biasedly arranged ahead of and adjacent the nozzle, on the distal end of a pair of pivot arms, which are coarticulable with a biased wiper pad, both of which swing when the nozzle is caused to pivot about its axis. The liner extender is a spring steel hoop having a broad loop at its distal end, and is biased to the pair of pivot arms, which arms are displacable with respect to the nozzle. The proximal end of the extender slidingly mates with a slot disposed in the distal end of a middle arm, arranged between the pair of pivot arms. The middle arm is secured by a pivot axis to the base of the extruder nozzle, and is adjustably secured thereto by a bolt and spring means which permits a slight "give" to the middle arm when pressed towards the extruder nozzle.

A first link is also connected to the pivot axis at the base of the extruder nozzle, and is adjustably secured thereto by a bolt and spring means which permits a slight "give" to the middle arm when pressed towards the extruder nozzle.

A first link is also connected to the pivot axis at the base of the extruder nozzle, which link is also pivotably connected to a second link by a second pivot axis. The second link being pivotable to the biased wiper pad. The pivot arms are each journaled at their lower ends to the second pivot axis.

The biased wiper pad is swingable between the side portions of the hoop, and has a lower segment which is pivotably attached to the base of the extruder nozzle, having a finger which extends downwardly therefrom, the distal end of which is pivotably secured to a control link. The upper end of the lower segment has a pad swingable thereon, and biased into general longitudinal conformity with the lower segment, by a spring arranged therebetween.

The extruder nozzle is movable through its pivotable relationship with an extruder mechanism, as recited in the above-identified incorporated commonly assigned patent.

In operation of the liner extender mechanism, the spreader nozzle is advanced towards a shoe upper which is secured by an arrangement of pincers, one at the back line edge, and one at each side of the upper, the heel pocket being exposed by the machine operator by his pulling the lower edge of the lining away from the nozzle when the operator loads the pincers. A lower arm and the control link are both pivotably connected to a longitudinally movable shaft which when retracted, effectuates the pivoting of the extruder nozzle about its axis on the extruder. Retraction of the lower arm also effectuates a pull on the control link to cause the biased wiper pad to rotate about the wiper pad axis. This causes the first and second links to assume a more linear orientation, and it pushes the pivot arms attached thereto which biasedly secure the liner extender, up toward the end of the slot through which they are disposed, the liner extender having a mid-portion which is held against displacement, by a spring, the net effect being the faning outwardly of the hoop of the liner extender (against the inside of a liner of a shoe upper) as the spreader nozzle is rotated to its pre-ejection orientation. The biased wiper pad concomitantly pivots forwardly as the spreader nozzle pivots about its axis, the pad portion being disposed on the opposite side of the liner that the liner extender is on. The liner extender is permitted to swing its hoop portion upwardly as well as to sweep its loop portion outwardly, ensuring that the sides of the liner are away from the path of travel of the spreader nozzle.

Advancement of the movable shaft is effective to pivot the spreader nozzle towards its upright position, discharging the resin on the inside of the upper, as recited in the aforementioned patent. The liner extender is also pivoted rearwardly and dropped downwardly at the same time, to properly avoid the liner which is being wiped into place by the biased wiper pad, as it also is caused to rotate towards its upright orientation. The liner extender is caused to be lowered into its "rest" orientation by the downward motion of the pivot arms pulling it down as the pivot arms are pulled downwardly by the hinged action of the second pivot axis between the first and second links. The spreader nozzle would be caused to withdraw from within the shoe upper by means described in the aforementioned patent, permitting further operative steps thereon, and then permitting the machine operator to remove the resin coated shoe upper from the pincers holding it in the machine.

BRIEF DESCRIPTION OF THE DRAWINGS

The objects and advantages of the present invention will become more apparent when viewed in conjunction with the following drawings, in which.

DESCRIPTIONS OF THE PREFERRED EMBODIMENT

Figure 1:
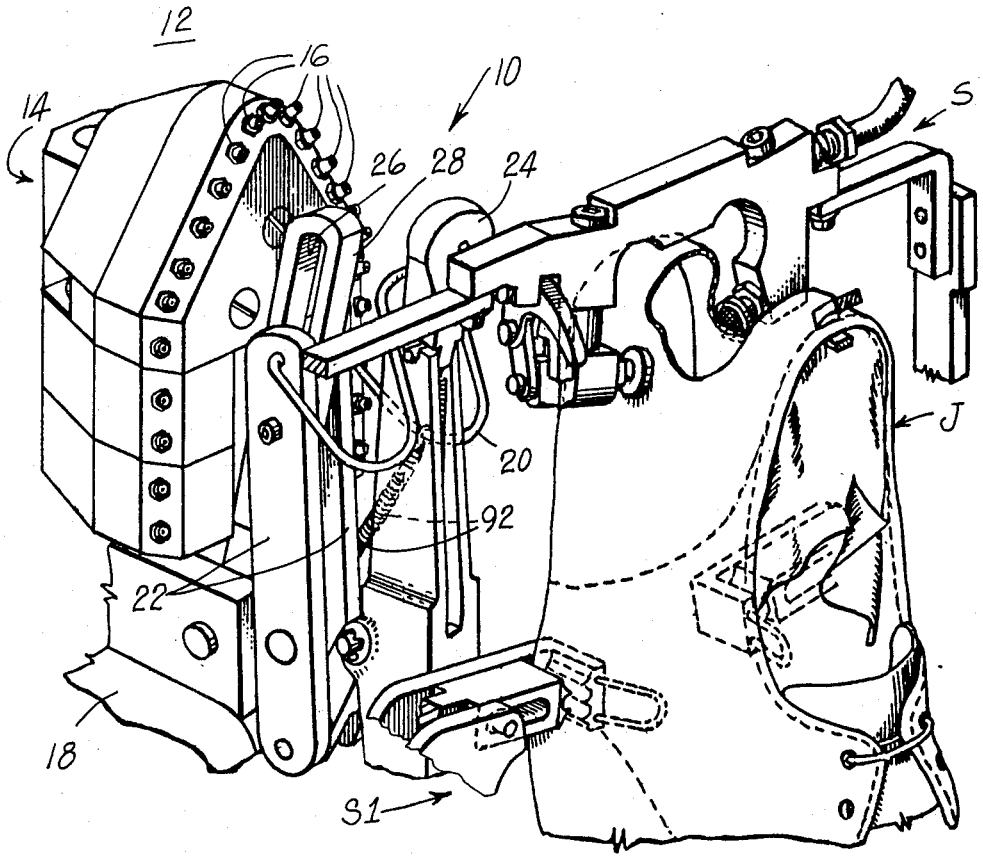
FIG. 1 is a perspective view of the nozzle and extender apparatus of a shoe upper machine.

Referring now to the drawings in detail, and particularly to FIG. 1, there is shown a liner extender mechanism 10 for use with a machine 12 for stiffening sheet material, particularly shoe uppers, generally similar to that shown in U.S. Pat. No. 4,344,199 which is herein incorporated by reference. The machine includes means, not shown, for softening a resin into a flowable state for application of that resin to a shoe upper "U"; held by support means "S" shown in FIG. 1. The machine 12 also includes a spreader nozzle 14 having a plurality of orificii 16 disposed thereon, the spreader nozzle 14 being articulatably disposed on an extruder head 18. The interior of the extruder 18 is in fluid flow communication with the interior of the spreader nozzle 14, and the interior of the extruder head 18 is in fluid flow communication with the aforementioned softening means. A liner extender 20 is arranged ahead of and adjacent the spreader nozzle 14, and is biasedly disposed on the distal end of a pair of pivot arms 22. The liner extender 20 may preferably be comprised of spring steel having generally the shape of the peripheral contour of a saddle. The pivot arms 22 are coarticulable with a biased wiper pad mechanism 24, which both swing when the spreader nozzle 14 is caused to pivot about its pivot axis 28. The proximal end of the liner extender 20 slidingly mates with the slot 26 in a middle arm 28, and has a spring 30, shown in FIG. 3, registered therearound to maintain the bias between the liner extender 20 and the pivot arms 22. The middle arm 28 is secured to a middle arm axis 32 at the base of the spreader nozzle 14, and is adjustably secured thereto by a bolt and spring means 34 which permits a slight "give" to the middle arm 28 when it may be pressed towards the spreader nozzle 14.

A first link 36 is also connected to the middle arm axis 32 at the base of the spreader nozzle 14, which link 36 is also connected to a second link 38 by a link pivot axis 40. The second link 38 is pivotably attached to a a midpoint of the biased wiper pad mechanism 24. The pivot arms 22 are each also journaled at their lower ends to the link pivot axis 40, their upper ends having the liner extender biasedly journaled therethrough.

Figure 2:
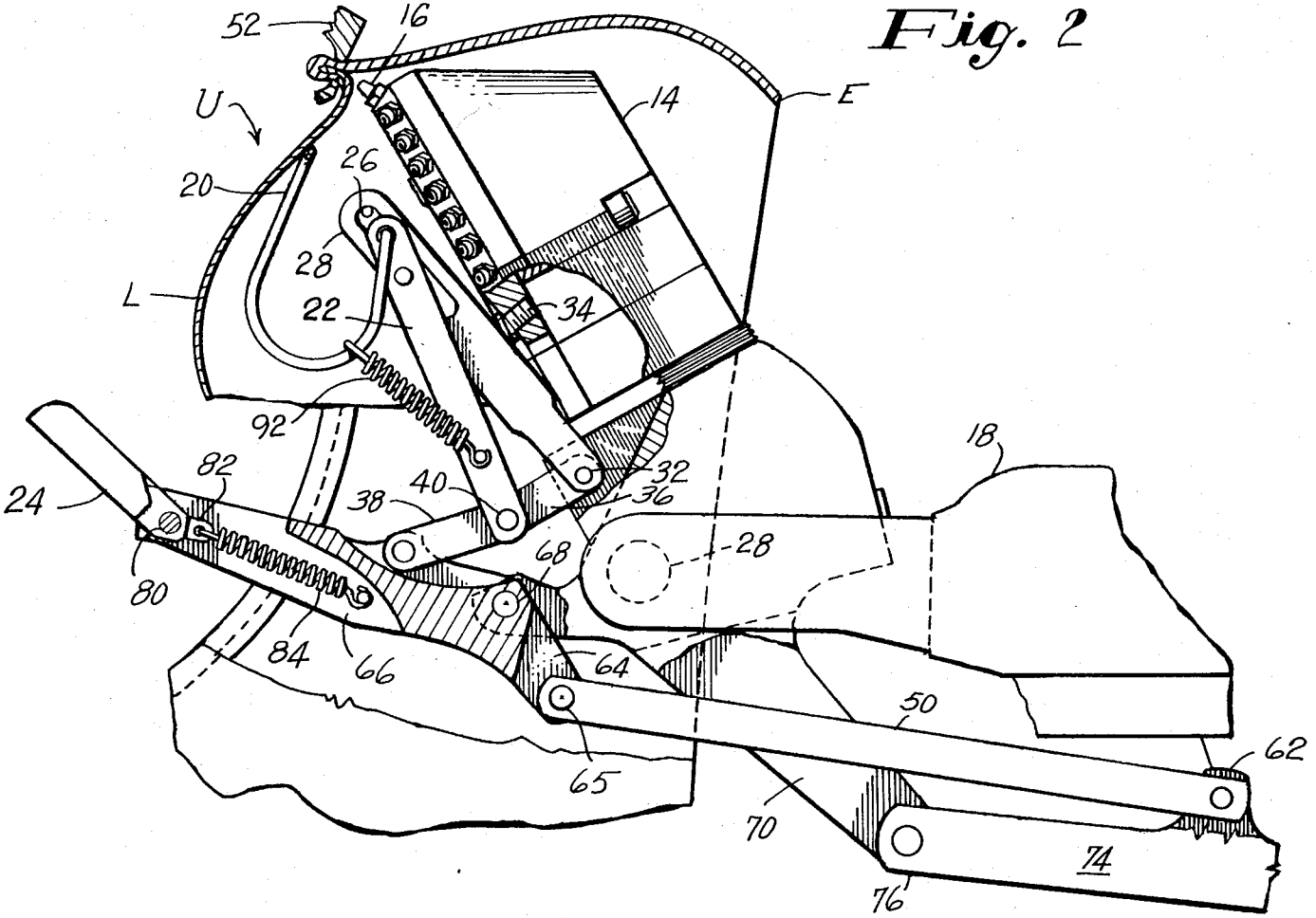
FIG. 2 is a side elevational view, showing the nozzle and extender apparatus in an operational orientation.
Figure 3:
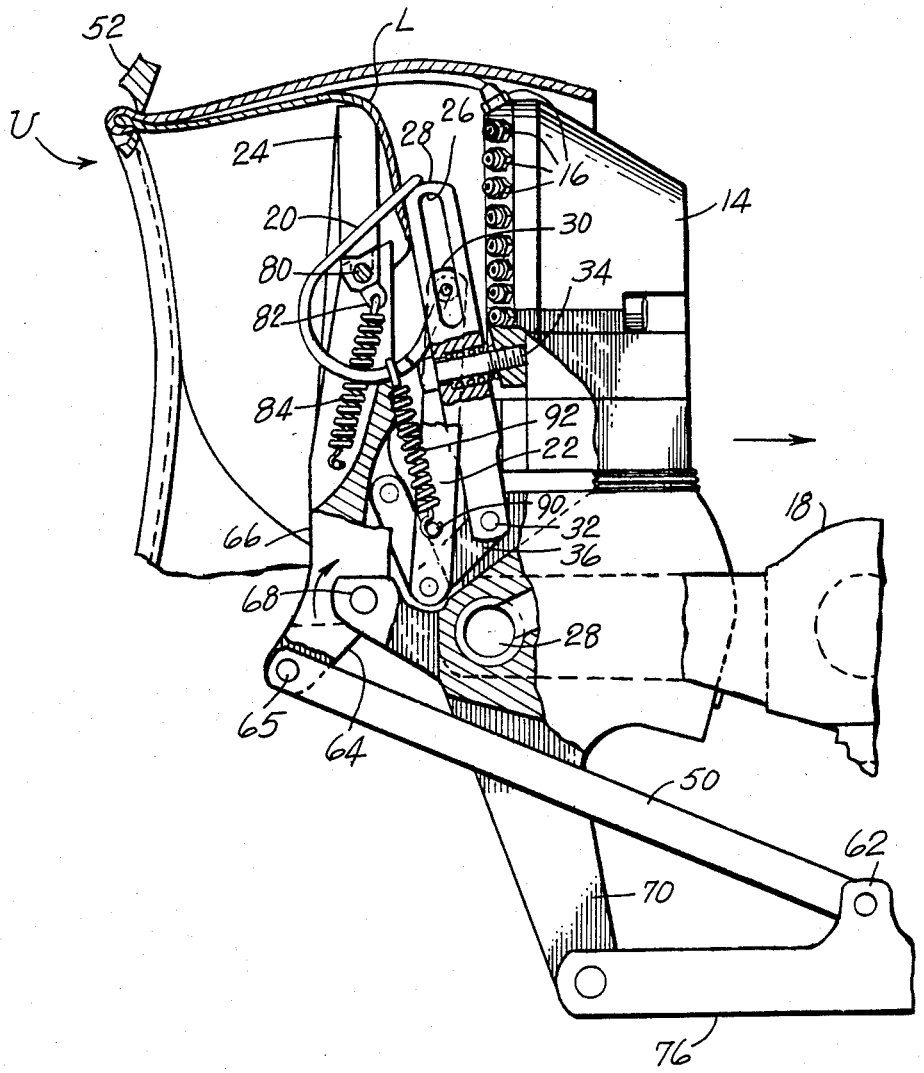
FIG. 3 is a view generally similar to FIG. 2, with portions of a shoe upper being manipulated at a later stage in the operation.

A shoe upper "U" is shown in FIG. 2 the upper "U" being formed of at least two sheets of flexible sheet material, one of which is an inner lining "L" sewn to the upper "U" along its top line edge. The lining "L" is movable from its position inside of the shoe upper "U" prior to its disposition in an upper pincer, as recited in the aforementioned patent, and as shown in FIGS. 2 and 3. The nozzle 14 and extruder 18 are advancable into the interior of the shoe upper "U". The wiper pad 24 slides beneath the liner "L" in the entry stroke and the liner extender 20 pushes outwardly and sidewardly against the interior of the liner "L" to enable the nozzle 14 to fit beneath the back part edge E of the upper U. Advancement of the nozzle 14 in its entry stroke is accompanied by pressurization of a lower cylinder (not shown), which causes retraction of a piston rod 74 therein (to the right as shown in the Figures). A lower linkage 76 is attached to the distal end of the piston rod 74, the lower linkage 76 being in pivotable contact with a lower arm 70 which extends downwardly from the spreader nozzle 14 at the bottom thereof. A control link 50 is pivotally attached to a standoff 62 on the lower linkage 76, the other end of which is pivotably connected to a pivot axis 65 on a downwardly extending finger 64 which comprises the lower portion of a wiper arm 66, the upper portion of which biasedly supports the wiper pad 24. The wiper arm 66 is pivotably supported on an axis 68 on the lower part of the nozzle 14.

The wiper pad 24 is of generally circular or "paddle-like" configuration, and pivots on an axis 80 on the upper end of the wiper arm 66. The wiper pad 24 has tab 82 which extends from the lowermost portion thereof, from which one end of a spring 84 is attached, which spring 84 has another end which is secured to a midpoint of the wiper arm 66.

A pin 90 is disposed transversely between the pair of pivot arms 22. A further spring 92 is attached between the pin 90 and each lower loop of the liner extender 20 to provide a downward bias thereon.

As the nozzle 14 is advanced to its discharge position into the shoe upper U by the advance of the extruder 18, the pressurization of the lower cylinder effects retraction of its piston rod 74 therewithin. This causes the lower linkage 76 to which it is attached, to be pulled to the right as shown in FIG. 2. The lower arm 70 is thus pulled rearwardly towards the extruder 18, effecting the pivoting of the nozzle 14 on its pivot axis 29, counterclockwise as shown in the drawings as the nozzle 14 is advanced forwardly (to the left in FIG. 2). As the lower arm 76 is retracted, it causes the control link 50 attached thereto, to be retracted as well. The nozzle 14 is caused to pivot about its pivot axis 28, and because of the spacial relationship between the pivot axis 65 on the downwardly extending finger 64 and the axis 68 supporting the wiper arm 66, the wiper arm 66 is caused to pivot, counterclockwise (forwardly and downwardly), as shown in FIG. 2, which permits the wiper pad 24 to be low enough to slide beneath the liner "L", as aforementioned.

The movement of the wiper arm 66 in a direction away from the extruder 18 causes the first and second links 36 and 38, to articulate towards a more linear relationship. The "more linear relationship" causes the second pivot axis 40, which connects the first and the second links 36 and 38, and which also supports the lower end of the pivot arms 22, to move upwardly. This causes the upper ends of the pivot arms 22 to move upwardly, including that portion of the liner extender 20 which is pivotably held therein, along the slot 26 in the middle arm 28. As the end of the liner extender 20 closest to the extruder 18 is moved upwardly, the distal loop portion thereof is caused to move down and forwardly, away from the advancing extruder 18. The downward movement is assured because of the securement caused by the further springs 92 arranged between the lower portions of the liner extender 20 and the middle arm 28. The distal loop of the liner extender 20 in its furthermost extended relationship presses against and keeps both the side portions as well as the heel portion of the liner "L" away from the inside portion of the shoe upper "U" as adhesive is being extruded from the orificii 16 along the perimeter of the nozzle 14 which is begun when the nozzle 14 is arranged in the upper, as shown in FIG. 2, at the top of the heel pocket.

As the extrusion of adhesive from the orificii 16 is occurring, the extruder 18 is caused to withdraw from the shoe upper "U" being held in the machine 12. The lower cylinder is being pressurized to effectuate pushing of the piston rod 74 from the lower cylinder to cause clockwise pivoting of the nozzle 14 about its pivot axis 29, extruding adhesive down the full height of the inside of the heel portion of the shoe upper "U". The control link 50 and the lower arm 70 are moved away from the extruder 18, to effectuate the reverse pivoting of the nozzle 14 (clockwise as shown in the Figures), and the upward reverse sweep of the distal loop of the liner extender 20, and the pushing back of the liner "L" against the now adhesively-wet portions of the heel pocket of the shoe upper "U" by the return (counter clockwise, as shown in FIG. 3) sweep of the wiper pad 24.

By providing a liner extender 20 having a wide almost round loop on its distal portion, the liner "L" may be properly held out of the way of the pivoting nozzle 14, and by providing a dual "up" and "away" movement in its advancing stroke and a "down" and "back" movement to its return stroke, a more problem free shoe upper can be produced. The biased wiper pad 24, acting in conjunction with the liner extender 20 is effectuated by common drive means to ensure the smooth and effectuous motion.

I claim:

1. A machine for stiffening an area between the heel pocket of a shoe upper and the lining which is secured to the shoe upper at the top edge of the heel pocket by applying a hot resinous material to the heel pocket comprising nozzle means for discharging hot resinous material, said nozzle means including a nozzle base, means for supporting said nozzle base for pivotal displacement about a first axis between an advanced position and a retracted position.

elongated wiper means including a wiper blade, said nozzle base including means for supporting said wiper means at a location remote from said wiper blade for pivotal displacement about a second axis parallel to said first axis from a remote position to a fully wiped position when said nozzle base is displaced from said advanced position to said retracted position, liner extending means including a liner engaging member, an elongated arm having first and second ends, means for securing said liner engaging member to the first end of said elongated arm, and means for supporting said liner extending means between said nozzle means and said wiper means including a first link member having first and second ends, said first link member pivotally secured at said first end to the second end of said elongated arm means and pivotally secured at the second end to said wiper means, a second link member having first and second ends, said second link member pivotally secured at said first end, with said first link, to the second end of said elongated arm and pivotally secured at the second end to said nozzle base, said elongated arm having a pin extending therefrom, and a control arm having a slot for receiving said pin.

2. A machine for stiffening an area between the heel pocket of a shoe upper and the lining according to claim 1, wherein said liner engaging member comprises a spring steel hoop having a broad loop at its distal end and wherein the ends of said hoop comprises said pin means.

3. A machine for stiffening an area between the heel pocket of a shoe upper and the lining according to claim 1, wherein said control arm is pivotally connected with the second end of said second link member to said nozzle base means.

* * * * *